US007576653B2

(12) United States Patent
Smith

(10) Patent No.: US 7,576,653 B2
(45) Date of Patent: Aug. 18, 2009

(54) SECURE PANEL WITH REMOTELY CONTROLLED EMBEDDED DEVICES

(75) Inventor: Fred Hewitt Smith, Old Town, ME (US)

(73) Assignee: Angel Secure Networks, Inc., Orono, ME (US)

( * ) Notice: Subject to any disclaimer, the term of this patent is extended or adjusted under 35 U.S.C. 154(b) by 0 days.

(21) Appl. No.: 11/724,879

(22) Filed: Mar. 15, 2007

(65) Prior Publication Data

US 2007/0229285 A1 Oct. 4, 2007

Related U.S. Application Data

(60) Provisional application No. 60/851,264, filed on Oct. 12, 2006, provisional application No. 60/782,438, filed on Mar. 15, 2006.

(51) Int. Cl.
*G08B 13/14* (2006.01)

(52) U.S. Cl. ..... 340/572.1; 340/10.1; 235/385

(58) Field of Classification Search ... 340/572.1–572.9, 340/10.1, 5.61, 568.2; 235/385
See application file for complete search history.

(56) References Cited

U.S. PATENT DOCUMENTS 5,461,385 A * 10/1995 Armstrong ..... 342/42
6,995,669 B2 2/2006 Morales
7,019,640 B2 3/2006 Canich et al.
7,030,411 B2 4/2006 Krulevitch et al.
7,162,007 B2 1/2007 Elyan et al.
7,165,484 B2 1/2007 Wang
7,176,793 B1 2/2007 Hummer
7,180,418 B1 2/2007 Willms et al.
7,181,132 B2 2/2007 Takehara et al.
7,188,513 B2 3/2007 Wilson
7,190,265 B1 3/2007 Bohinc, Jr.
7,191,942 B2 3/2007 Aptekar
2003/0075608 A1* 4/2003 Atherton ..... 235/492
2003/0173408 A1* 9/2003 Mosher et al. ..... 235/492
2005/0184871 A1* 8/2005 Coste ..... 340/568.2
2005/0225432 A1* 10/2005 Lindskog ..... 340/5.73

OTHER PUBLICATIONS

PCT International Search Report — (PCT/US07/06604) Date of Mailing Aug. 01, 2008.

* cited by examiner

*Primary Examiner*—George Bugg
(74) *Attorney, Agent, or Firm*—Foley & Lardner LLP; Ralph Trementozzi; Christopher E. Everett

(57) ABSTRACT

Devices and methods for securing an asset include providing a plurality of dispersed, interconnected electronic components integrally attached to a structural member of the secured asset. Each electronic component of the plurality of components is in communication with a remotely accessible interface and includes a memory for storing a respective subdivision of at least one numeric value. The numeric values can be inserted, altered, or deleted remotely through the remotely accessible interface. Upon detection of an attempted breach of the secured asset or tamper with the structural member, one or more of the stored sub-divisions are selectively destroyed. Detection of an attempted breach or tamper is remotely observable upon inspection of a previously stored numeric value, subsequently altered in response to detection of a breach of the secured asset.

32 Claims, 13 Drawing Sheets

SECURE PANEL WITH REMOTELY CONTROLLED EMBEDDED DEVICES

RELATED APPLICATION

This application claims priority to U.S. Provisional Patent Application No. 60/782,438, filed on Mar. 15, 2006 and to U.S. Provisional Patent Application No. 60/851,264, filed on Oct. 12, 2006. The entire teachings of both of the above applications are incorporated herein by reference.

GOVERNMENT SPONSORSHIP

This invention was made with Government support under Contract No. N66001-05-C-6014 awarded by SPAWAR Systems Center San Diego and also with Government support under Contract No. FA8650-06-C-8050 awarded by USAF/AFMC. The Government has certain rights in this invention.

FIELD OF THE INVENTION

The invention relates to systems and methods for ensuring security of a sensitive asset. More particularly, the present invention relates to systems and methods for remotely managing data stored by networked processors configured to detect compromise of the sensitive asset.

BACKGROUND

There has been a recognition that the United States is at risk of the delivery of weapons of mass destruction to its ports by enemies employing a strategy of hiding such a weapon in a shipping container. Various schemes have been proposed for x-raying containers or otherwise examining containers as they are loaded on ships in the foreign port. Such schemes, however, can be very limited in effectiveness since they can be defeated with x-ray shielding, vulnerable to compromise by rogue employees and the contents of the containers altered after they are loaded in the foreign port.

To a limited degree, the notion of embedding detecting devices in a container, which communicate with external systems, has been implemented in unsecure applications. For example, Sensitech, based in Beverly, Mass. (www.sensitech.com), provides solutions in the food and pharmaceuticals fields that are used for monitoring temperature and humidity for goods in-process, in-transit, in-storage, and on-display. So, temperature and humidity monitors can be placed in storage and transit containers to ensure desired conditions are maintained.

However, such data is not generally considered sensitive with respect to security issues. Rather, it is used for ensuring the products in the container do not spoil by being subjected to unfavorable temperature and humidity conditions. Consequently, secure communications, tamper resistance and detection are not particularly relevant issues in such settings.

Even if detectors are introduced into a container and interfaced to an external system, an "adversary" may employ any of a variety of strategies to defeat such a detection system. For instance, an adversary may attempt to shield the suspicious materials or activities from the detectors; defeat the communication interface between the detectors and the external system, so that the interface does not report evidence of suspicious materials or activities sensed by the detectors; disconnect the detectors from the interface; surreptitiously load a container that contains an atomic weapon, but that does not contain detecting devices, onto a container ship; overcome external systems so that they incorrectly report on the status of the detectors.

The difficult aspect of the environment is that the detecting devices and the communications interface will be in the hands of the potential enemy for some period of time, at least for the period of time necessary to load the container. Also, since the potential enemy is presumed capable of constructing an atomic weapon, the enemy must be presumed able to utilize other advanced technologies suitable for defeating the detecting devices and the interface.

SUMMARY OF THE INVENTION

The invention relates to embedded sensors and other dispersed, interconnected electronics elements placed in one or more structural members of a secured asset. The embedded sensors can be managed using a remote monitor interconnected to the secured asset by one or more of a wireless communications link and a communications network, such as the Internet. In an exemplary application, the secured asset includes ISO standard shipping containers. In such applications, one or more of the top, side, and bottom panels of the shipping container are configured with the embedded sensors and other dispersed, interconnected electronic elements. In some embodiments, these panels are formed from a dielectric material, such as a resin-based composite material, configured with the sensors and other dispersed, interconnected electronics elements embedded therein. Other applications include such electronics embedded in devices used to interrogate such shipping containers. Still other applications include truck bodies, car bodies, rolling stock containers, and external devices that might be used to communicate with the sensors and electronics embedded in said truck bodies, car bodies, and rolling stock containers.

In one aspect, the invention relates to a tamper detection device, including a structural member configured for incorporation into a secured asset. The structural member includes several dispersed, interconnected electronic components integrally attached to the structural member, with more than one of the dispersed, interconnected electronic components including a memory element for storing a respective subdivision of at least one numeric value. The numeric value is stored among more than one of the dispersed, interconnected electronic components. A remotely accessible interface is in communication with the interconnected electronic components and configured to allow remote management of the at least one stored numeric value.

In another aspect, the invention relates to an ISO compliant shipping container asset comprising at least one structural member with a plurality of dispersed, interconnected processors embedded therein, adapted to receive and produce a numeric value that cannot be falsified, by a procedure that would solve a riddle using the stored numeric value without sending the stored numeric value outside.

In another aspect, the invention relates to an ISO compliant shipping container including at least one structural member with a plurality of dispersed, interconnected processors embedded therein, each of the processors storing a respective sub-division of at least one numeric value, the numeric value being stored among more than one of the dispersed, interconnected processors. The container also includes a power source; and a high-energy device in communication with the power source and adapted to irretrievably destroy one or more of the stored sub-divisions of the at least one numeric value. The high-energy device can be provided in an area within a wall of the composite material, allowing a high-energy destruction processes to be undertaken against one or more of the processors.

In yet another aspect, the invention relates to a tamper detection system, including a structural member configured for incorporation into a secured asset. The structural member includes several dispersed, interconnected electronic components integrally attached to the structural member. More than one of the plurality of dispersed, interconnected electronic components includes a memory element for storing a respective sub-division of at least one numeric value, the numeric value being stored among the more than one of the dispersed, interconnected electronic components. The structural member includes a remotely accessible interface in communication with the interconnected electronic components, which is configured to allow remote management of the at least one stored numeric value. A remote monitor is provided in communication with the remotely accessible interface, whereby numerical values can be remotely installed into the structural member and verified without placing any trust in an on-site operator.

In yet another aspect, the invention relates to a process for detecting attempts at tampering with a secured asset, including generating a numeric value, subdividing the numeric value into a plurality of sub-divisions, and storing subdivisions of the numeric value in respective electrical components of several distributed, interconnected components contained within a structural member of the secured asset; monitoring at least one tamper alarm is monitored and at least one of the stored subdivisions of the numeric value is destroyed in response to the monitored tamper alarm indicating attempted tampering, such that the detected tampering is detectable by said destruction.

BRIEF DESCRIPTION OF THE FIGURES

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE EMBODIMENTS

A description of preferred embodiments of the invention follows.

Structural members including a plurality of dispersed, interconnected electronic components integrally attached thereto can be used in the construction of an asset to secure it from attacks by an adversary by identifying any such attempted attacks. An asset, once secured, is modified to store at least one numeric value associated with the secured asset. A numeric value representative of the numeric value stored in the asset is also stored in a remote database. Structural members are configured to irrevocably alter the stored numeric value upon detection of an attempted attack or tampering. Integrity of the secured asset can be accomplished by inspection of the stored numeric value and comparison to the representative numeric value stored in the remote database. Parity between these values indicates that the asset remains secured.

Figure 1:
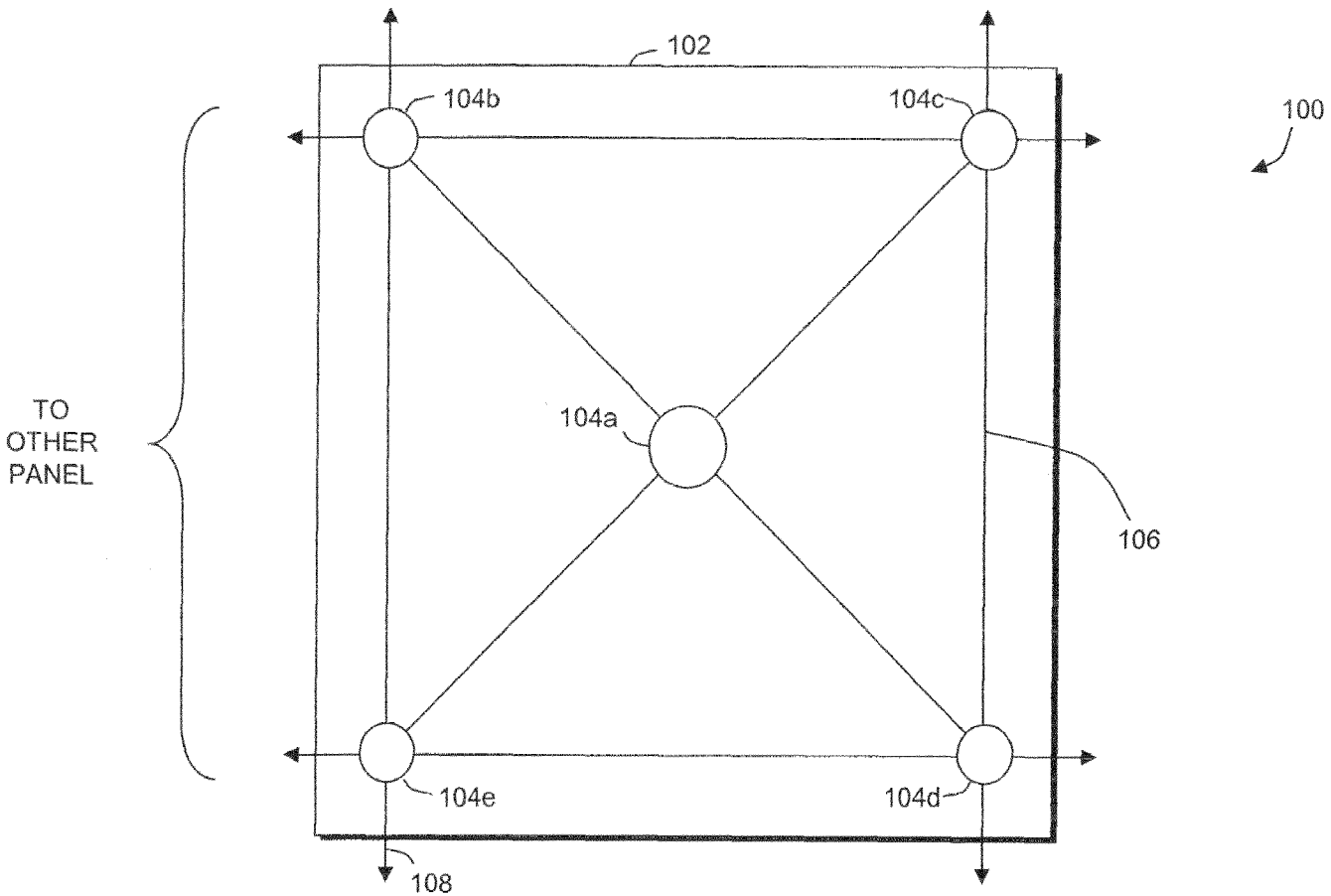
FIG. 1 is a schematic diagram illustrating an exemplary structural member including dispersed, interconnected electronic components in accordance with the present invention.
Figure 2:
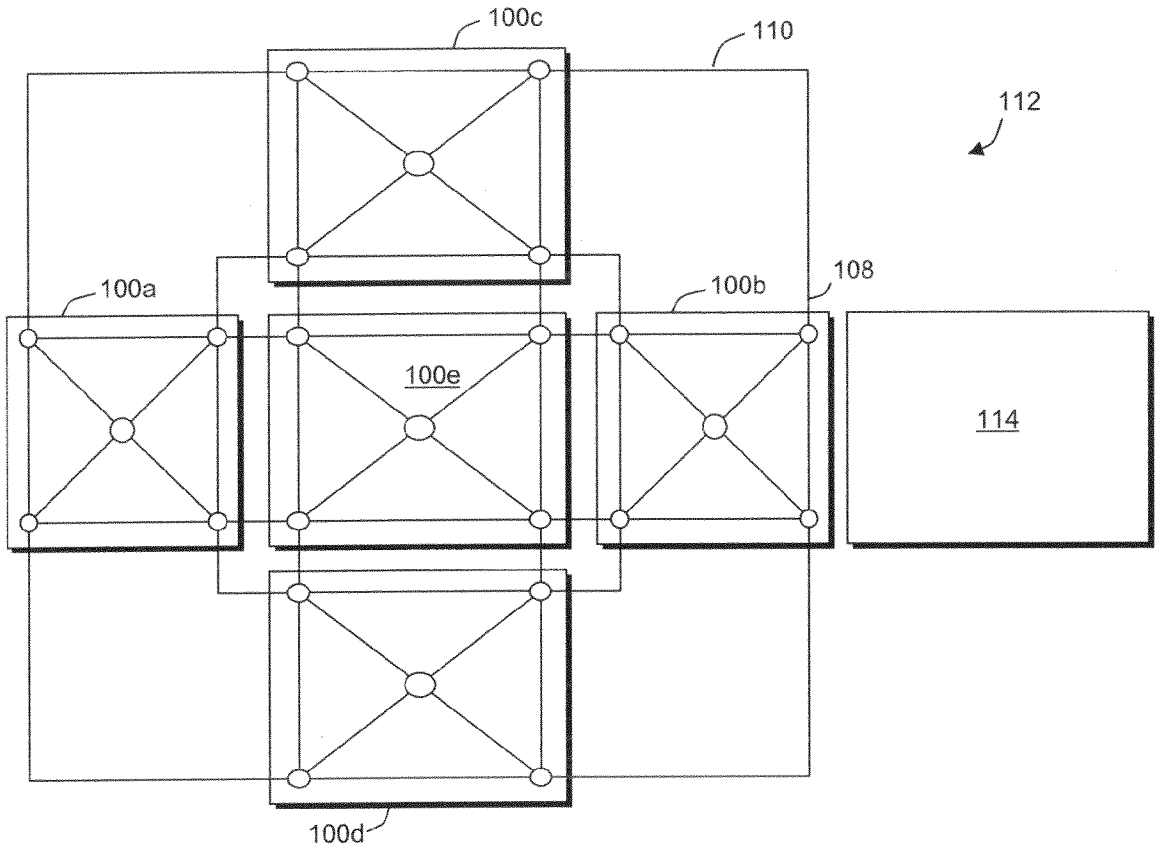
FIG. 2 is a schematic diagram illustrating interconnection of multiple structural members of FIG. 1.

FIG. 1 is a schematic diagram illustrating an exemplary structural member 100 including a panel 102. The structural member 100 includes multiple electronic components 104*a*, 104*b*, 104*c*, 1024, 104*e* (generally 104) distributed throughout the structural member 100 and attached to the panel 102. Each of the electronic components 104 is coupled to one or more other electronic components 104 via electrical connections 106. Preferably, each of the electronic components 104 is coupled to more than one of the other electronic components 104 to preserve networked interconnection of all active electronic components 104 in the event of one of the electronic component 104 failing. In some embodiments, the structural member 100 includes one or more interconnects 108, each in communication with a respective one of the electronic components 104 and adapted for interconnection with similar electronic components 104 of an adjacent structural member (FIG. 2). At least some of the electronic components 104 include a local memory for storing a respective portion, or sub-division of a numeric value as will be described in more detail below.

FIG. 2 is a schematic diagram illustrating electrical interconnection of multiple structural members 100 as may be used for a rectangular container asset, such as a shipping container. Illustrated are left and right panels 100*a*, 100*b*, front, rear, and top panels 100*c*, 100*d*, 100*e*, and a bottom panel 114. In this exemplary embodiment, each of the left, right, front, rear, and top panels 100*a*, 100*b*, 100*c*, 100*d*, 100*e* (generally) are similar to the structural member 100 of FIG. 1. One or more jumpers 110 are provided to join together corresponding electrical interconnects 108 of adjacent panels 100. Thus, a shipping container 112 configured as shown provides a single dispersed, interconnected network of electronic devices 104. In some embodiments, one or more of the panels 100, such as a bottom panel 114 need not be outfitted with electronic devices 104, if tampering of such a location is unlikely, or if the risk of damage to the electrical components 104 is too great.

Figure 3:
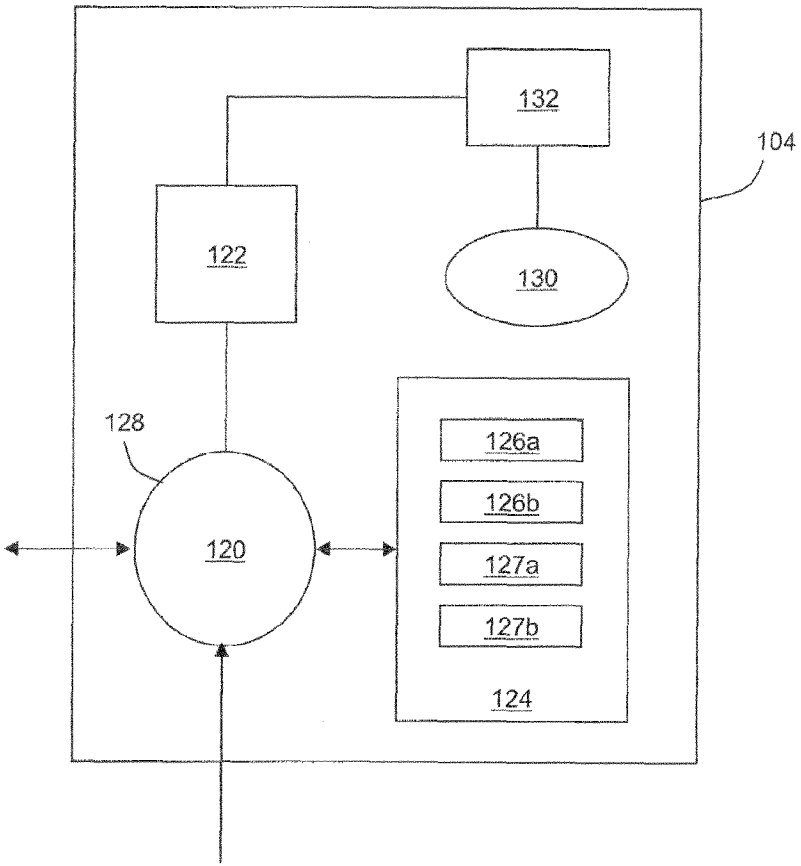
FIG. 3 is a block diagram illustrating in more detail an exemplary one of the electronic components of FIG. 1.

As shown in more detail in FIG. 3, an exemplary embodiment of one of the electronic components 104 includes a microprocessor 120, a local power source 122, and a local memory 124. The microprocessor 120, powered by the local power source 122, includes a communications interface 128 that can be used for communicating with other electronic components 104. The microprocessor 120 is also in electrical communication with the local memory 124 that can be used to store one or more numeric values in the form of digital words. As described below, these values can include private and public portions of an ID value 126*a*, 126*b* (generally 126) and private and public portions of a certificate value 127*a*, 127*b* (generally 127). ID values 126 can be preloaded during construction of the structural member 100; whereas, the certificate values 127 can be loaded and re-loaded in the field, as required.

In operation, the microprocessor 120 receives one or more of the numeric values 126, 127 over the communications interface 128 and stores (i.e., writes) them in the local memory 124. In response to a remote inquiry as to the stored values, the microprocessor 120 reads the requested values from local memory 124 and forwards them to the requester via the communications interface 128.

Some of the electronic components 104 are configured to receive an input from an external sensor. Sensors can be configured detect a potential breach of or attempted unauthorized access to a secured asset. For example, a sensor may include a photo detector to detect a change in ambient light as might occur during unauthorized opening of a shipping container. Other sensors are configured to detect a physical breach of a container through one or more embedded sensors that might be compromised if a panel of the container was breached. Still other sensors can include thermal sensors, acoustic sensors, shock and vibration sensors, tipping sensors, etc.

As shown, at least some of the electronic components 104 can include a high-energy device 130 located proximate to the local memory 124. The high-energy device 130 can include an incendiary device or a small explosive charge (i.e., squib). Upon activation, the high-energy device 130 physically destroys at least a significant portion of the local memory 124 making it impossible for an adversary to reconstruct data that may have been stored therein. The high-energy device 130 receives an input signal from a tamper sensor 132. The tamper sensor 132 may be the same sensor providing input to the microprocessor 120, or a separate sensor 132 as shown. In some embodiments, two sensors are provided, such that a first sensor used to delete memory in response to a sensed event and a second sensor is used to physically destroy memory in response to a sensed event.

In some embodiments, very low power processors 120 are provided in substrate layers. Very low power, very small processors are currently commercially available, such as the model no. MSP430 series available from Texas Instruments of Dallas, Tex., and the model PIC F10 series, available from Microchip Technology, Inc of Chandler, Ariz., each of which is suitable for being embedded in composite materials in accordance with the invention. Such very low power processors 120 are designed to run with a power source 122, such as a permanent battery, for a period of up to ten years, with present device costs starting at about $0.49, and a current size that is approximately one-tenth the size of a penny (4 mm×4 mm). The size and the cost per unit will probably decrease significantly in the future.

In some embodiments, the structural member is formed of a composite material. within which the processors 120 are mounted on a substrate layer. Thus, the composite material replaces standard PVC board on which electronic devices are commonly mounted. To achieve this mounting, the processors are mounted on a substrate fabric, such as a glass fiber, or other type of layer, to allow a resin to flow through the substrate and bond so as to prevent delamination of the resulting composite material.

However, it is not necessary to embed the processors continuously throughout the composite material. In some embodiments, processors are mounted in locations in the composite material where the processors 120 would be less likely to incur damage from forklifts and other normal conditions in a shipping environment.

Figure 4:
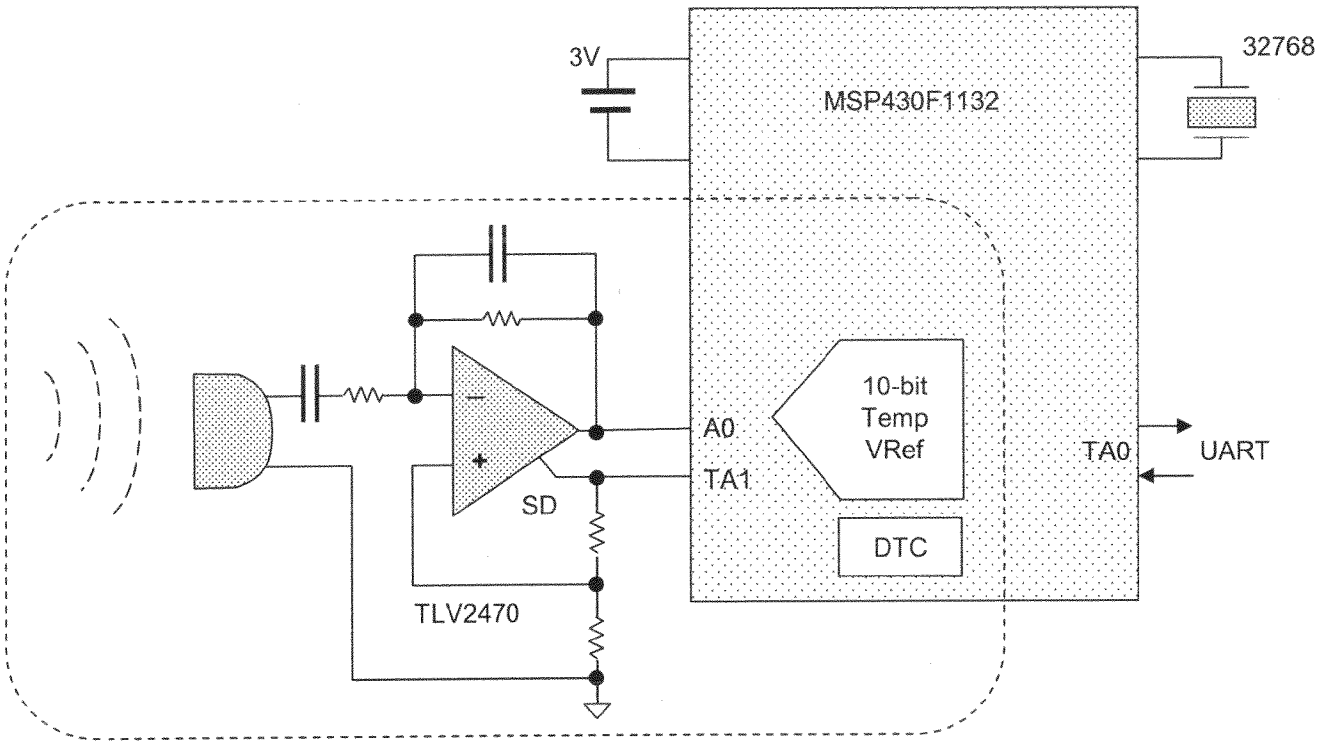
FIG. 4 is a schematic diagram illustrating an example of a very low power wake up configuration.

Using very low power processors 120, applications can run for up to ten years from a single lithium battery 122. These processors 120 can respond to sudden events and "wake up" as shown in the glass shattering diagram in FIG. 4. The processor operates in sleep mode until glass shatter is detected, upon which event the processor wakes up. If the processor 120 is not continuously running but can transition to a wake mode or "wake up" in response to alarms, the battery 122 will last much longer.

Moreover, the "normal" condition of a shipping container is that nothing is happening. Only on relatively few occasions does something occur, either an inspection or an attack, that requires the use of processors 120. The wake up could occur as the result of an intrusion or as the result of receipt of an external signal, such as an wireless, or RF signal. There are similar designs for the PIC F10 device. If the processors 120 run in a sleep mode, and are awakened either by (a) an intrusion, or by (b) an external RF signal attempting to contact them. Once again, each processor 120 can be easily powered for up to a ten-year life from a single battery 122. If the processor 120 waits for an incoming signal and wakes up, the processor 120 will consume significantly less power than if the processor 120 periodically wakes up and broadcasts a wireless signal on the possibility that a receiver might be in the vicinity. Both modes of operation are contemplated.

In accordance with another strategy to conserve batteries 122, power is supplied to the processor 120 from an outside power source in circumstances where it would be convenient to do so, for example, if an operator could stand next to the container that was being queried, in a factory, or during a loading procedure.

Consequently, in some embodiments, electronic devices 104 using the design above described are embedded in a substrate 102 (FIG. 1) within a corrugated container panel 100, including permanent batteries 122. The electronic devices 104 are configured to default to a very low power sleep mode during periods of inactivity and to transition to a wake more or "wake up" in the event of an event, such as an intrusion, an external RF signal, or some other event.

In some embodiments, very low power processors 120 are embedded in composite substrates 102 and used to manage container ID and certificate values. The very low power processors 120 have the ability to store data in flash memory 124 and to erase data from flash memory 124. Consequently, they are utilized to provide an ID and a certificate to a composite panel 100 or a collection of such panels 100 joined to make an ISO shipping container. In a preferred embodiment, very low-powered processors 120 are networked together in a substrate grid 106, 108, 110. The networked processors 120 manage the detection grids and provide ID and certificate values as described below.

The ID value is a numeric value that uniquely identifies a particular securable asset. This value is generally provided at a factory at time of manufacture of the secured asset. In some embodiments, it is possible to reassign an ID value, as may be required during maintenance activity in which a defective structural member is removed and replaced with a new, functional member. A certificate value is a numeric value that is given to a secured asset after it has been inspected and secured in some fashion, such as being locked or sealed. Continuing with the exemplary embodiment, a shipping container will very likely have numerous certificate values over the course of its lifetime, and even quite possibly during the course of a single shipment. For example, a shipping container is issued a first certificate value after an inspection conducted prior to the container being loaded onto a container ship or at an approved factory. If the container were thereafter reopened or damaged, it would likely require a new certificate value indicative of a subsequent inspection conducted after the reopening or damage is repaired.

A container requires ID and certificate values that cannot be "spoofed" by an adversary. A capable adversary might attempt to steal a container after it had been inspected (i.e., including valid ID and certificate values), and to substitute another shipping container containing dangerous contraband spoofing the ID and the certificate values obtained from the properly inspected stolen container.

The following paragraphs describe an exemplary embodiment of a procedure for using structural members, such as composite panels, configured with embedded processors to prevent such spoofing of ID and certificate values, whereby composite material containers can be used to prevent spoofing of IDs and certificates and the procedure for implementing these security measures.

In accordance with the invention, IDs and certificates are installed and hidden within the composite material by way of dispersed, interconnected embedded electronic components. The ID and certificate values, or at least values corresponding to these values are maintained in one or more remote, secure databases. The remotely maintained ID and certificate values can be used to develop complex riddles that cannot be answered correctly by a remote container unless that container has access to the previously installed ID and certificate values.

Figure 5:
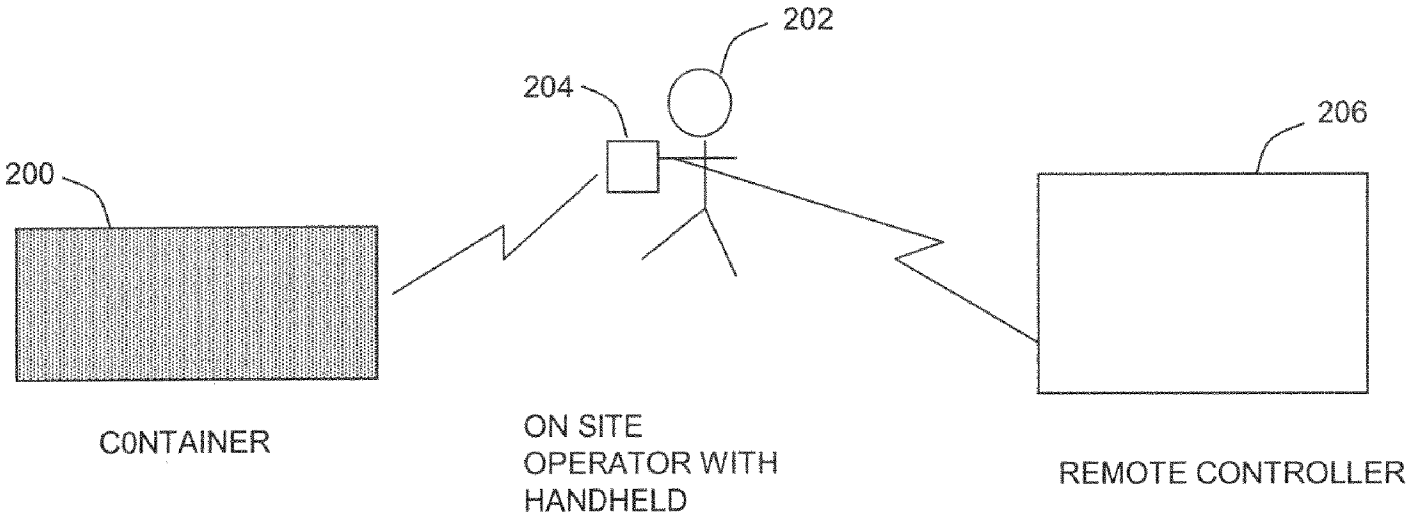
FIG. 5 is a block diagram illustrating remote monitoring of a container in the field.

As shown in FIG. 5, a secured container asset 200 is in wireless communication with an onsite operator 202 operating a handheld wireless communications device 204. The operator 202, in turn, is in communication with a remote monitor 206 that participates in management and storage of ID and certificate values within the container 200. In some embodiments, a form of encryption is used to prevent interception of either of the ID and certificate values during the course of their management. Unfortunately, protection provided by this method can be overcome should an adversary possess sufficient resources to reverse engineer a container, thereby obtaining the stored values of the hidden ID and certificate values from the container.

One such reverse engineering technique employs focused ion beam (FIB) technology. FIB technology allows for stored values contained in a hardware device to be extracted. To prevent such an attack, extraordinary measures must generally be undertaken, such as fundamentally destroying the device or modifying the size of nano-components. Consequently, in order to protect the ID and certificate values, a container is configured with one or more sensors to detect an attack, and a high-energy device to completely destroy the stored value(s) before the device containing the stored value (s) can be extracted and subjected to FIB analysis.

In one form of the invention, numerous very low power processors are scattered throughout a composite container, with more than one of the processors storing one or more values therein. The ID and the certificates for the container are set up to represent a combination of values stored in various processors located in various parts of the container. In some embodiments, each of these values is sub-divided into a number of sub-division values that are each stored in a respective one of the scattered processors. Such a subdivision can be accomplished by dividing and truncating, by selecting predetermined bits of a field, or any other subdividing procedure generally known. The stored value can be reconstructed by a reverse process, such as concatenation, or other methods. Consequently, upon detecting an attack, the container can prevent a spoofing attack from succeeding by destroying only a single one of the stored sub-divided values. Reconstruction of the stored value would be different from the originally stored value if one or more of the subdivided values were deleted or altered. Thus, the attack would be detectable, since the ID or the certificate used to answer a riddle would be different.

In some embodiments, various processors 120 check on one another, and if any processor has found that another processor was not available, it destroys the value it protects. Such checking can be accomplished using an interprocessor communications protocol across the electrical interconnections 106 (FIG. 1) between processors 120 (FIG. 3). For example, each processor periodically sends a message to one or more interconnected processors requesting some sort of response. If a response is not obtained, the requesting processor presumes that an attack has occurred. Consequently, this presents an adversary with the problem of having to disable all processors before any of the processors realize that an attack is occurring. The possibility of such an occurrence is complicated for embodiments in which processors are scattered throughout the composite material and hidden from the naked eye.

Preferably, each of the processors has its own permanently embedded power supply. Avoiding a common or shared power supply, eliminates any risk of multiple processors being disabled simultaneously by the disabling of a single power supply. In a container, unlike a single integrated circuit chip, there are a great variety of strategies that can be implemented to render infeasible an attack whereby all processors are disabled before any become aware of the attack. For example, numerous devices might be used including active electronic devices and passive electronic devices provided to spoof external probing techniques, whereby such techniques would have difficulty distinguishing a real electronic device from a dummy. Alternatively or in addition, sensors can be included within the structural member to detect probing attempts at locating a device. For example, sensors can be provided to detect the use of high-energy radiation and x-rays. For applications in which secured container assets are routinely subjected to such high-energy radiation, or x-rayed, time limits can be implemented into the sensors, such that they report an event indicative of an attack having occurred when another code has not been received within a predetermined time period. No event is reported if the other code is received before expiration of the time limit. Alternatively or in addition, the processors can be surrounded by a denser grid of detection wires to detect a physical attack against a sensor. These strategies become more powerful when processors are embedded in a larger volume, such as a shipping container.

Just because a value is erased from flash memory does not necessarily mean that the value cannot thereafter be restored. A composite material is particularly well suited to implement procedures whereby values can be irrecoverably destroyed. Values could be located in special flash memory that could be subjected to high-energy destruction. These memory locations could be surrounded by material that would concentrate the energy applied and that would prevent any environmental hazard to operators. In some forms, a permanent battery is supplied solely to power permanent destruction of values. A stored subdivision of a number can also be destroyed by altering the atomic composition of the physical elements of the subdivision. This can be accomplished, for example, by using quantum dots to encode the subdivision and then altering the atomic structure of one or more such dots.

For the ID and certificate values stored within the very low power processors embedded within the composite panels, two sets of values can be utilized. One value is referred to as a public value, which the container would use to identify itself to an external entity as may occur when queried via a wireless interrogation from a nearby handheld or other device. This public value is subject to spoofing by a capable adversary, even if it were encrypted.

A second, private value remains within the embedded PC, and is never broadcast. The first value can be verified by sending a randomly generated riddle to the embedded network of processors. The riddle can be answered by processing the riddle against the hidden values and returning an answer. It would be computationally impossible to discern the hidden value from the riddle and the answer. The riddle preferably is a randomly generated value sufficiently large so that it is computationally impossible to guess which riddle might be posed next by a remote authority. Such a public/private technique is generally referred to asymmetric cryptography (i.e., public key cryptography), as described in U.S. application Ser. No. 10/600,738 filed on Jun. 20, 2003, claiming priority to U.S. Provisional Application Nos. 60/390,204 and 60/390,205, both filed on Jun. 20, 2002, the references incorporated herein by reference in their entireties. It should be noted that the scheme described herein can be implemented without resort to techniques such as elliptic curve or RSA cryptography. For example, the scheme can be implemented simply by using appropriate hashing functions as the basis for the riddle solution. There are numerous other ways known in the art to implement the riddle solution function in accordance with the description provided in this disclosure.

In some embodiments, certificates can be tied to one or more of the ID value and one or more prior certificates. By way of example, a container may have a factory installed ID and a several certificates, and that another certificate is then installed after an inspection. This last certificate can be a combination of a remotely generated value combined with a value generated at the time of the installation. In this example, even if an adversary could somehow intercept and decode the most recently installed value, that would not be sufficient to spoof the certificate. The composite container presents the possibility of using numerous values stored in different locations within the container, and of installing these values at different times.

Preferably, each of the ID and certificate values are installed into the panel in a secure manner to prevent detection by a potential adversary. To securely install an ID or certificate, at least one processor is large enough to implement asymmetric encryption. This processor might need to be more capable, and therefore require more energy, than a processor needed to monitor status or monitor receipt of an RF signal indicating an inquiry. The more capable processor could normally be left in a state where it was not running. On the relatively few occasions where more power is needed, it is turned on by other processors, used, and then turned off. The composite container presents the possibilities of using a variety of processors, so that processors requiring minimal power are used whenever possible.

Figure 6A:
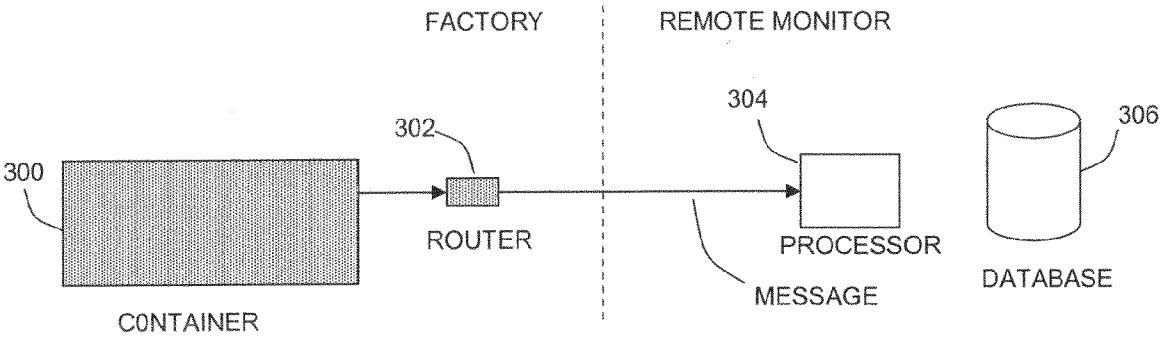
FIG. 6A and FIG. 6B are block diagrams illustrating secure remote installation of an identification (ID) numeric value at the factory.
Figure 6B:
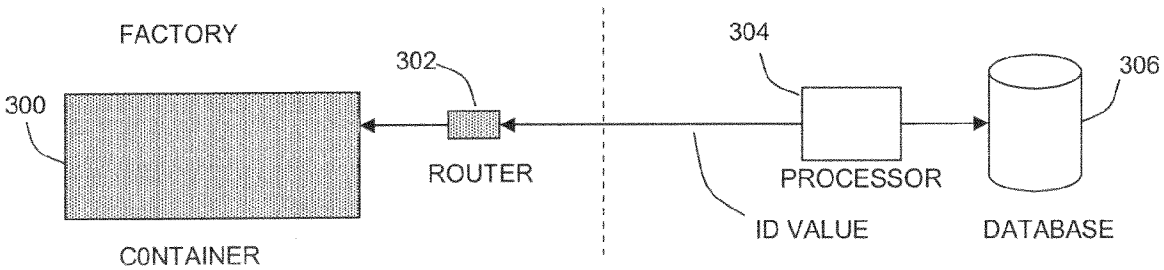

An exemplary process for installing an ID value during manufacture of a panel or container including one or more panels constructed according to the principles of the present invention, is shown in FIG. 6A and FIG. 6B. Using an embedded processor (not shown), the composite container 300 generates an asymmetric key pair. (This may require a relatively more capable processor than the very low power processors used to store subdivisions of the numeric values.) The container 300 communicates with a local router 302, which then routes the message to a remote monitor 304. Using asymmetric cryptographic methods known to those skilled in the art, the remote monitor 304 and composite container 300 establish a session key.

The remote monitor 304 randomly generates an ID value, encrypts it with the predetermined session key, transfers it to composite container 300, and also saves copy in remote databases 306. The ID value is then subdivided and distributed among more than one of the multiple embedded, very low power processors in the composite container 300.

Advantages of this procedure for installing an ID are as follows. First, there are times when a more capable processor is not needed, for example at times when the container 300 is not being interrogated, so these processors can be temporarily turned off. In such cases, the container 300 must be capable of being awakened when an attack is detected, or when someone needs to communicate with it, but during the sleeping period the processors can utilize very limited amounts of power. Second, no trust is placed in any operator on site in the manufacturing facility. Security required at this facility would not be as high as the security required at the site where the remote monitor was maintained.

Figure 7:
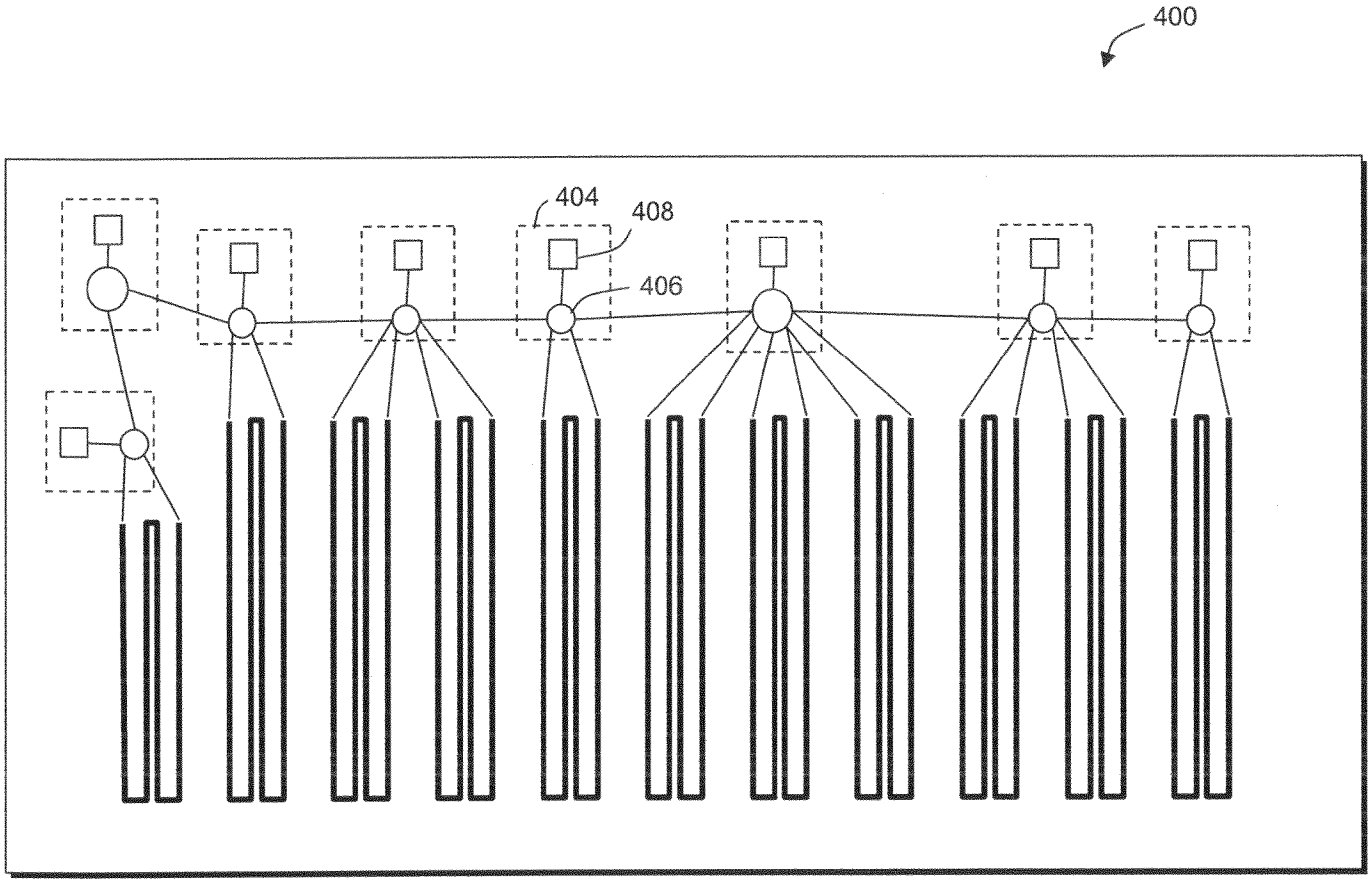
FIG. 7 is a schematic diagram illustrating a structural member in the form of a container wall having embedded processors and detection grids.

An exemplary composite container panel 400 is illustrated in FIG. 7. The composite panel 400 includes multiple electronic components 404 disbursed throughout a composite panel material 402. Each of the electronic components 404 includes a respective processor 406', 406" (generally 406) and local memory 408. The processors can include very low power processors 406' for storing managing stored values in a local memory and more powerful processors 406" that alternatively or in addition provide additional functions, such as coordinating assembly and sub-division of stored values among the multiple electronic components 404 and for implementing asymmetric cryptography.

All of the electronic components 404 are interconnected forming a network. The interconnections 410 can include wires, cables, fiber optic cables, and combinations thereof. As shown, some of the electronic components 404 are connected to more than one of the other electronic components. At least some of the electronic components are connected to sensors for detecting attempted intrusion or tampering. As shown, the sensors can include buried wires or fiber optic cables routed in circuitous paths throughout the panel 402. An attempt to breach the panel that severs one or more of the circuitous paths can be detected from sensor circuitry monitoring such paths. Exemplary sensors are described in U.S. Provisional Application No. 60/872,956 filed on Dec. 4, 2006 and incorporated herein by reference in its entirety.

An ID value is subdivided and distributed among some number of embedded very low power processors 406. The low power processors 406 have permanent embedded batteries 408 and communicate with one another over the interconnecting paths 410. If a processor 406 detects an attack on itself, or notices that another processor 406 is not active, it destroys part of the ID subdivision that it controls. Processors 406 can include special destruction methods, such as embedded burn bags, to assure non-recoverable destruction. See FIG. 8. Embedded burn bags are not shown in FIG. 7.

Processors 406 are multiply connected as described herein, so that should one processor 406 be destroyed, the network of processors will be preserved, allowing remaining processor 406 to continue communicating. Generally, unless an adversary attempts to remove a processor 406 from the surrounding composite material 402, ordinary erasure of some part of the ID material is sufficient, which means that the flash memory of the processor 406 will not be destroyed. However, if an adversary attempts to remove the processor 406 from the composite material 402, other techniques are employed to physically destroy the flash memory in the processor 406.

Figure 9:
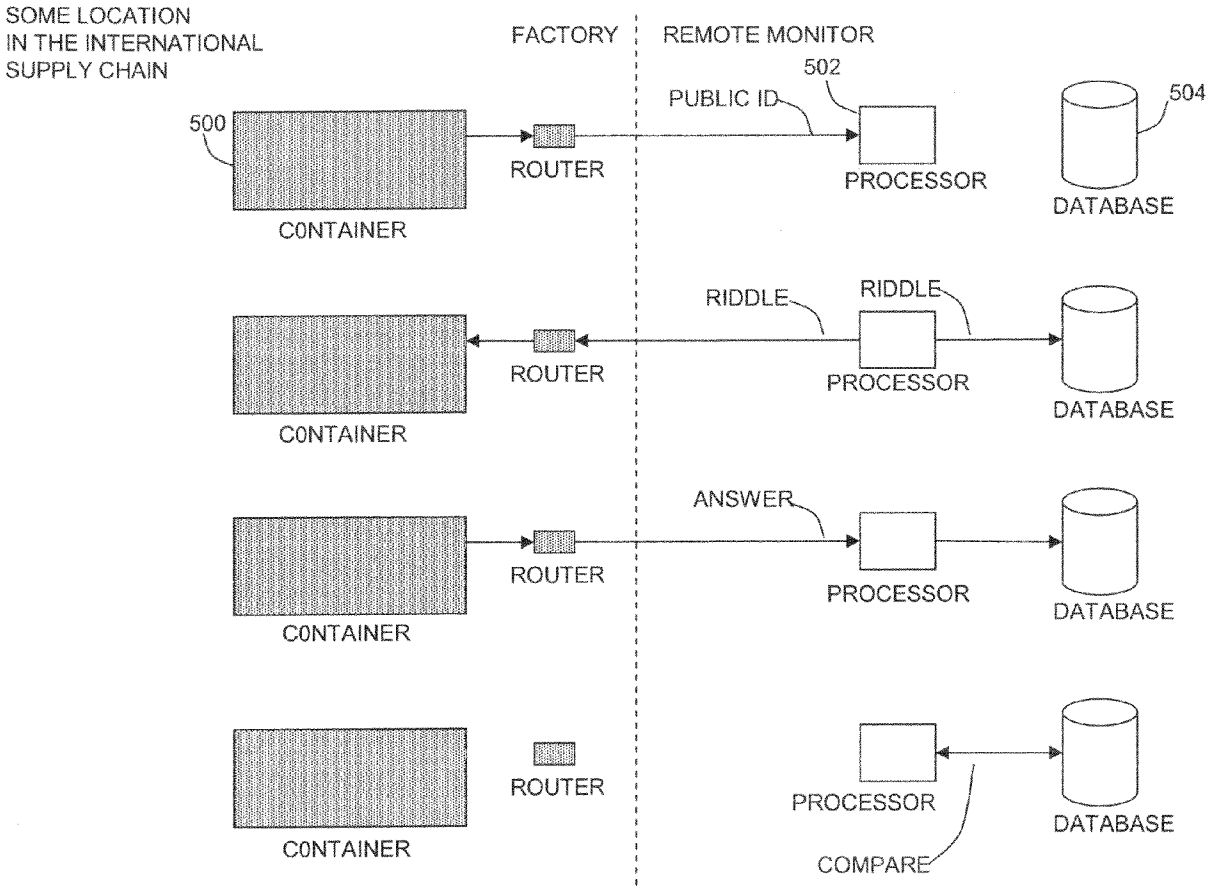
FIG. 9 is a block diagram illustrating remote ID verification of a container in the field.

Referring now to FIG. 9, an exemplary process is described for remotely verifying an ID value previously installed in a panel or container 500 including one or more panels constructed according to the principles of the present invention. A remote monitor 502 obtains public portion of ID from the container 500. The public portion of the ID value could be spoofed by an adversary. The remote monitor 502 randomly generates a riddle, which is a large binary number. The container 500 solves the riddle using the various hidden portions of the ID value. The container 500 sends back the answer, which is also a binary number.

Using the remotely stored values, which the remote monitor 502 knows that the container possess, the remote monitor 502 solves the same riddle, and compares its answer with the answer received from the container and stored in a remote database 504. An adversary cannot determine the hidden values from the riddle and its answer. This approach is secure even if the public ID, the riddle, and the answer are not encrypted.

An exemplary process is described for installing certificate value in a fielded panel or container including one or more panels constructed according to the principles of the present invention. A certificate is installed in the field after a container is inspected and found to be safe. The container is sealed at this time, with that the installed certificate indicative of the inspection and sealing process. If the container thereafter detects an attack, such as an intrusion, at least a portion of the previously installed certificate value is destroyed, thereby voiding the certificate value.

A certificate value is installed into the container 500 after it has passes inspection and is closed. This certificate, once stored, can be verified by a remote scanning machine or can be assumed safe as coming from a safe factory. The container 500 generates an asymmetric key pair. Using asymmetric methods, remote monitor 502 and container 500 establish a session key. Remote monitor 502 randomly generates certificate material, encrypts it with session key, and transfers it to container 500. Also, saves copy in remote data bases 504. With this process, trust need not be placed in the remote operator.

Figure 10:
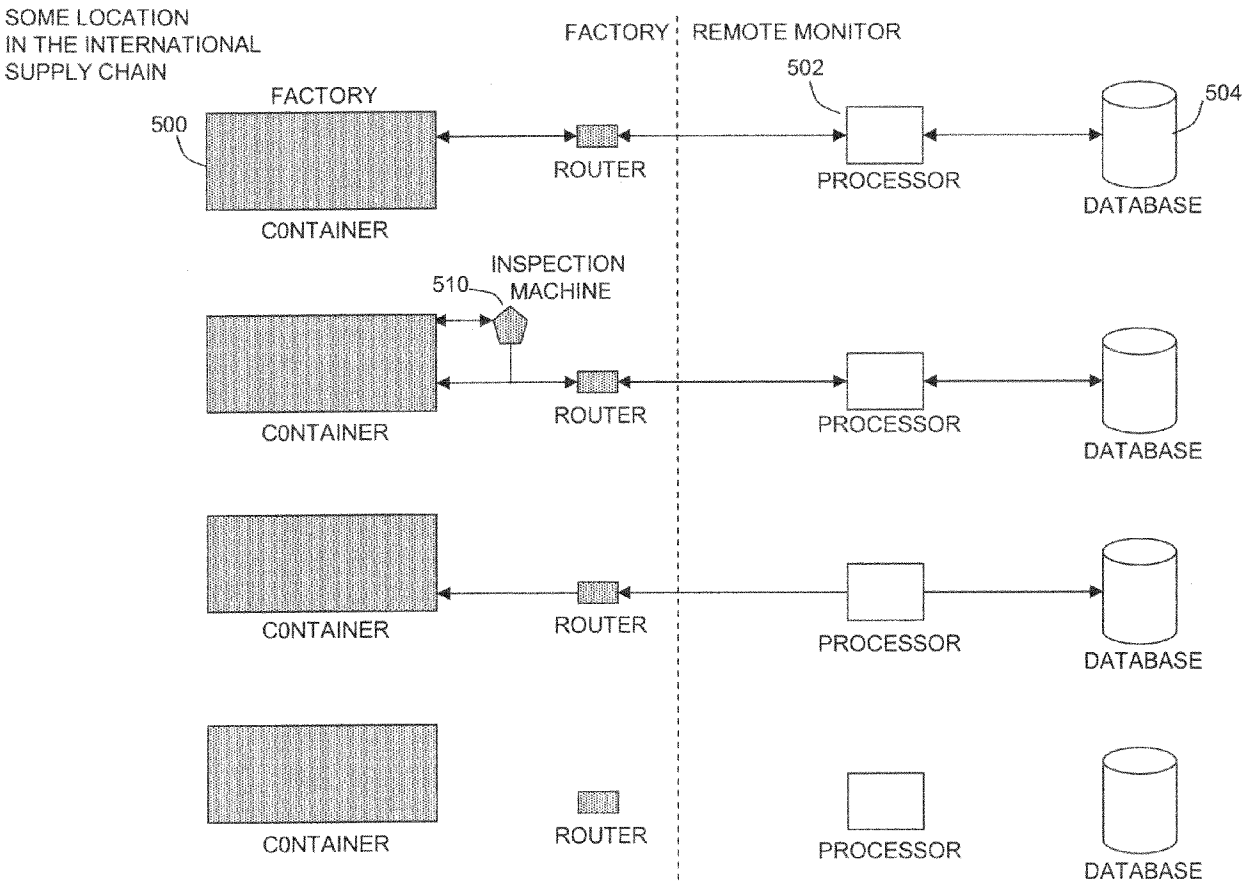
FIG. 10 is a schematic diagram illustrating remote, secure installation of a certificate numeric value.

Referring now to FIG. 10, an inspection machine 510 connected to the remote monitor 502. This procedure allows remote inspection of a container 500, remote verification that the container 500 being inspected is the container 500 of interest, and, if the container 500 passes inspection, remote installation of the certificate without a need to trust an on-site operator. Under this procedure, the inspection machine 510 communicates with the container 500 so that the inspection machine 510 can independently verify the identity of the container 500 being inspected. The design of the inspection machine 510 is not specified in this application, but implementation of such a capability can be accomplished using techniques generally known to those skilled in the art.

The state of an exemplary container is illustrated in FIG. 7, after installation of a certificate. Certificate material is distributed among some number of embedded very low power processors 406. Processors 406 storing respective subdivisions or portions of the certificate may or may not be same processors 406 storing respective portions of the ID value. If a processor 406 detects an attack on itself, or notices that another processor is not active, it destroys part of the ID or certificate material that it controls. Processors 406 may include special destruction methods, as described herein to assure non-recoverable destruction.

Figure 11:
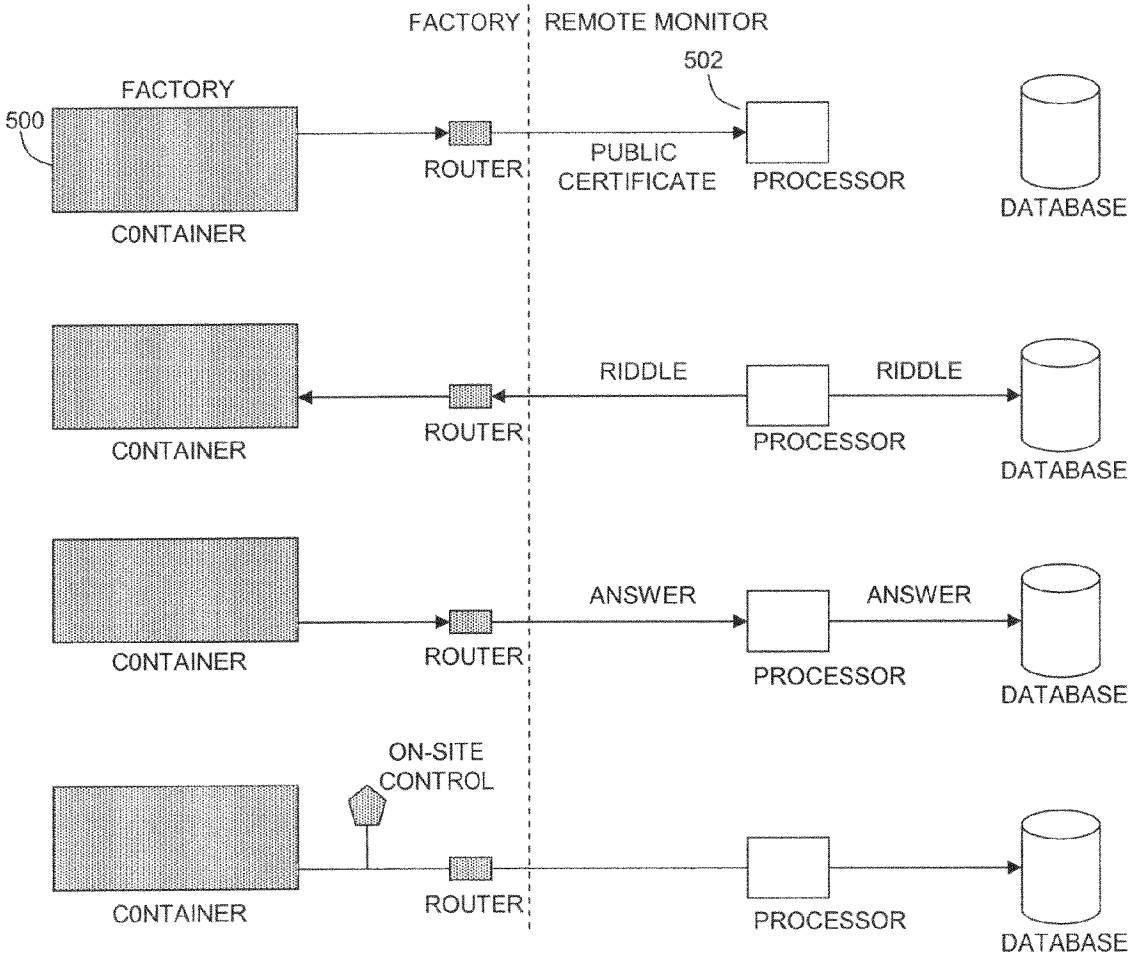
FIG. 11 is a schematic diagram illustrating remote verification of a certificate value.

Referring now to FIG. 11, an exemplary process is described for remotely verifying a previously installed certificate value in a fielded panel or container including one or more panels constructed according to the principles of the present invention. Remote monitor 502 obtains public portion of ID from the container 500. This could be spoofed by an adversary. The remote monitor 502 randomly generates a riddle and forward it to the container 500. The container 500 solves the riddle using the various hidden portions of the ID and the recently installed certificate. The container 500 returns to the remote monitor 502 an answer to the riddle.

The remote monitor 502 uses remotely stored values for the ID and the certificate, which it knows the container 500 possess, to solve the same riddle sent to the container 500. The remote monitor 502 then compares its answer with the answer received from the container 500. An adversary cannot determine the hidden values from the riddle and its answer. This approach is secure even if the public ID, the riddle, and the answer are not encrypted. The approach would be secure even if the adversary knew hidden ID values or the hidden certificate values, but not both. In application, operators can be instructed not to load or, better yet, automatically prevented by a remote control facility from loading a container 500 onto a ship bound for a U.S. port, if the container 500 does not contain a verifiable certificate.

Figure 8:
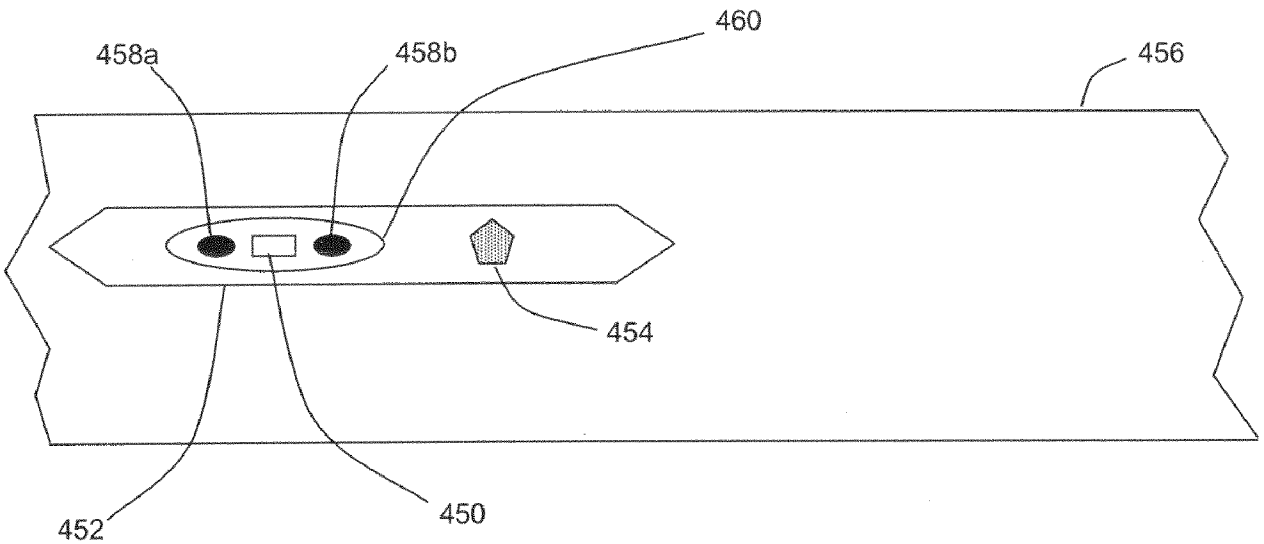
FIG. 8 is a block diagram illustrating a structural member including high-energy devices to selectively destroy stored numeric values.

In accordance with the invention, the electronic component, or sub-element therein, is embedded in a substrate or a composite material in such a way that an attempt to remove the component results in permanent destruction of the values it contains. An exemplary embodiment of such technology is shown in FIG. 8. A micro-controller 450 is shown with flash memory. The micro-controller 450 contains part of a certificate installed in the field. If an attack is detected, at least part of this value is erased, with the result that the container does not thereafter pass an inspection of the certificate. If the value erased from the micro-controller 450 could be recovered by an adversary, the adversary could conceivably manufacture a new container that would not contain evidence that a breach had been detected.

The device includes a detection grid 452 is shown surrounding the micro-controller 450 and power source 454, also protected by the detection grid 452. An attempt by an adversary to remove the micro-controller 450 from the composite material 456 breaks the detection grid 452, which triggers an active destruction of the micro-controller 450. The active destruction can result from one or more incendiary devices 458*a*, 458*b* that permanently destroy the micro-controller 450 so that forensic analysis would not be possible, even using FIB technology. The micro-controller 450 and the incendiary devices 458*a*, 458*b* are optionally surrounded by a containment envelope 460 to concentrate the force of the incendiary devices 458*a*, 458*b* and optionally provide a measure of safety for nearby operators.

Figure 12:
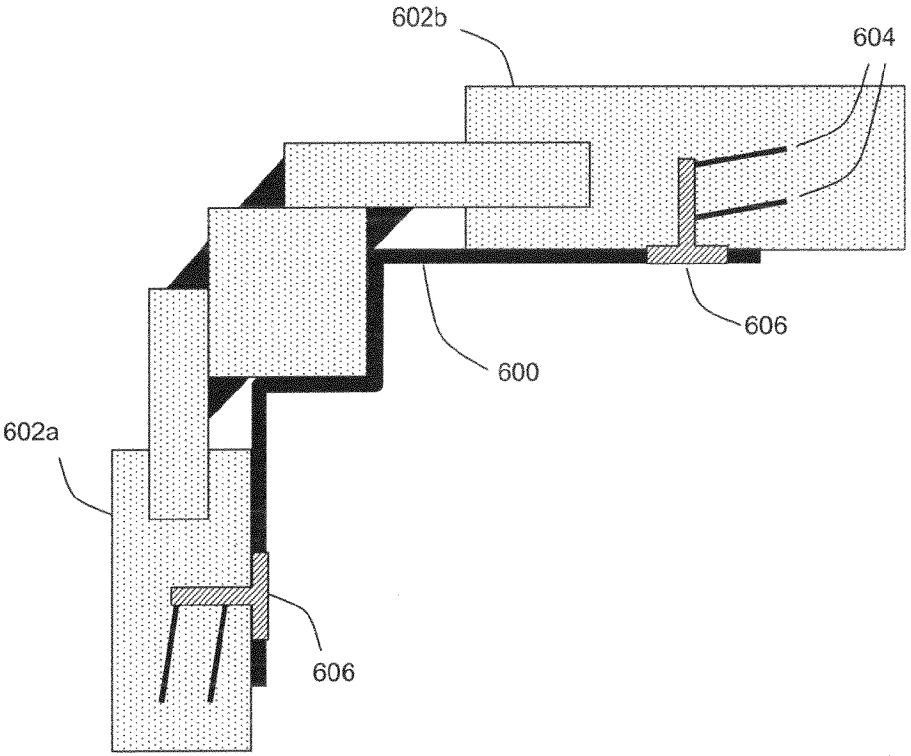
FIG. 12 is cross-sectional diagram of a corner portion of an asset illustrating a hard-wired coupling between two of the structural members of FIG. 1, allowing communicate therebetween.

In some embodiments, an asset, such as a shipping container, includes multiple panels, each constructed in accordance with the principles of the present invention. Each of the panels can be provided as a unit in itself without being hard-wired to one or more other panels. Hard-wiring panels together would stress them even more. In an alternate embodiment, referring now to FIG. 12, a coupling 600 is attached between adjacent panels 602*a*, 602*b* (generally 602) allowing the panels 602 to communicate with one another.

As described earlier, each panel includes a number of distributed, interconnected electronic components embedded therein. The components are interconnected by electrical connections 604, some of which terminate in terminals 606 along an edge of the panel 602. A coupling 600 in the form of a low-profile jumper extends between terminals 606 of adjacent panels 602 thereby providing an electrical bridge between the panels 602.

If the panels 602 could be taken apart and reassembled in the field, then the stored ID and the certificate values would change depending on which set of panels made up a particular container. If the panels 602 could be taken apart and reassembled, defective panels 602 could be replaced when they were defective and the panels 602 could be shipped unassembled, six sets of panels 602 to a container. Also, unassembled panels 602 would present less of a danger for unauthorized shipment of cargo.

A disadvantage of panels 602 that are hard wired together, or that can be taken apart and reassembled in the field is that such panels 602 may not be capable of manufacture using existing methods for building shipping containers. Because panels can be constructed using existing shipping container manufacturing methods, the composite panel may be more easily introduced into industry.

In accordance with one method of assembling a container, a composite frame is used and the panels are screwed into the frame. The composite frame slightly reduces the weight of the container. The screws preferably are designed so that they connect data and electrical paths between panels, and so they detect attempts to unscrew the panels. A composite frame facilitates breaking the container into component parts, which simplifies maintenance and shipping of empty containers. When the cost advantages of a lighter container, maintenance, and ability to ship empty containers is considered, the composite container with a composite frame can be less costly than a container with a composite panels connected to a steel frame.

Greater security is achieved by attaching a composite frame member containing embedded grids and processors such that if the panels are separated, the separation could be detected, and an alarm is sounded.

The composite panels may be joined to a composite frame by screw fasteners as previously described in this disclosure to maintain connectivity between panels by a mechanical connection or by optical methods. When a container is assembled in this fashion, loaded with cargo, and closed, and issued a certificate, attempting to take the container apart can be detected by the embedded network and treated as an intrusion. The advantage of this approach is that the container can be shipped unassembled and assembled on site when required. This approach also allows for field replacement of defective panels.

Figure 13:
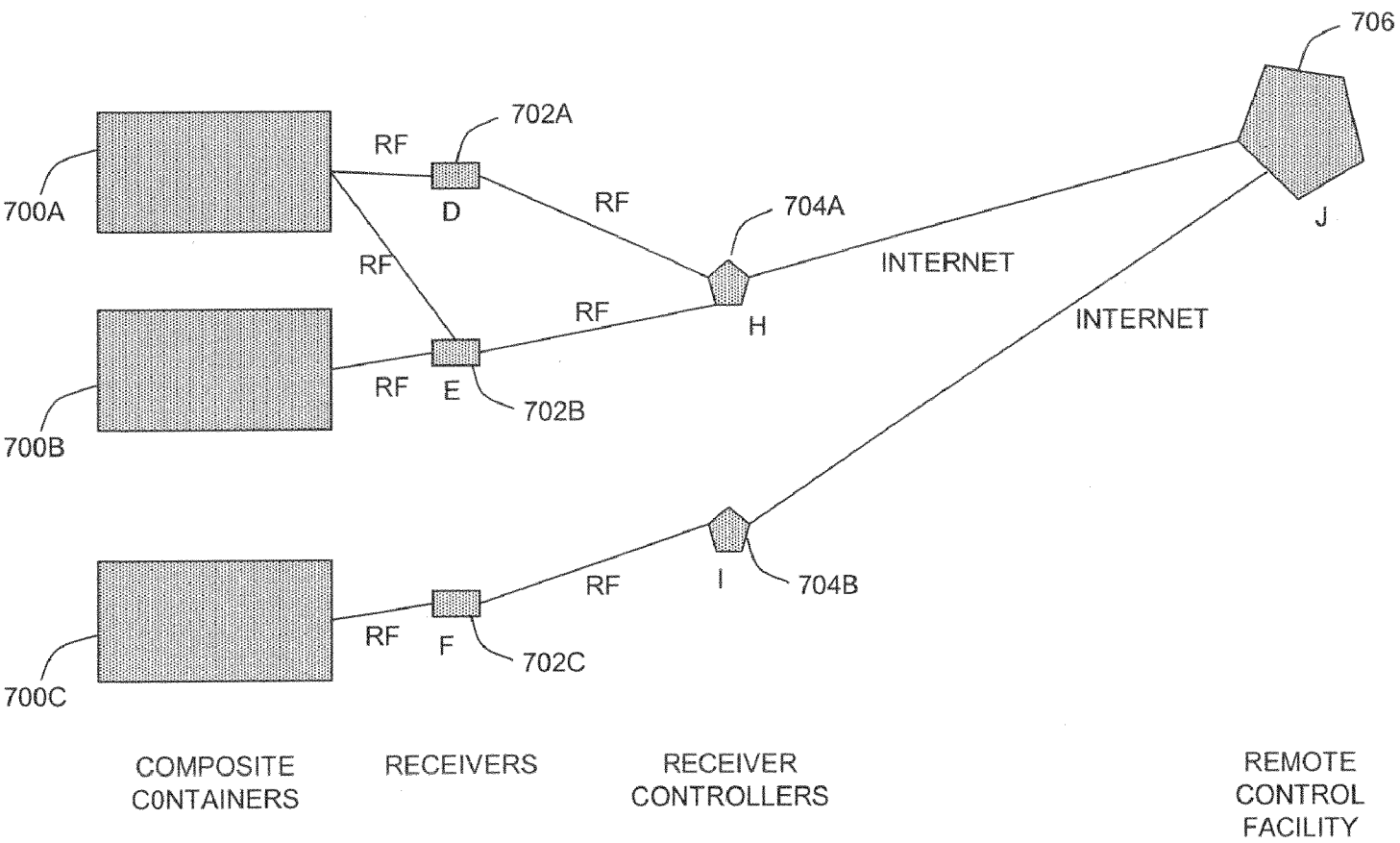
FIG. 13 is a schematic diagram illustrating an exemplary communications network between a container made the structural members of FIG. 1 and a remote control facility.

An exemplary remote monitoring configuration is shown in FIG. 13 including three separate shipping containers 700*a*, 700*b*, 700*c* (generally 700) each including composite materials with distributed, interconnected electrical components for storing numeric values as described herein. Other configurations such as truck bodies, automobile bodies, air containers and so forth are possible.

The composite materials in the shipping container 700 communicate wirelessly with local wireless receivers 702*a*, 702*b*, 702*c* (generally 702). The receivers 702 can also be made of composite materials with embedded networks of electronic components and are presumably located nearby the containers, for example, on a pole to interact with wireless interface on each container 700 when the containers 700 pass into a dock. In other applications, such receivers can be embedded in the roadway. Preferably, the receivers are connected to a source of power, such as utility power for fixed installation receivers. The wireless receivers wake up the corresponding receivers in the container 700 and initiate a wireless communication session. Utilized in this manner, the network inside the container 700 sleeps most of the time to conserve battery power. The receivers 702 are also constructed in such a way as to detect attacks on themselves. The receivers 702 are made from very durable composite material so they can withstand the rigors of the maritime or harsh environment.

In some embodiments, as shown, receivers 702 redundantly communicate with the same container 700. Thus, a second receiver 702*b* is communicating with both first and second containers 700*a*, 700*b*.

The receiver 702 communicate wirelessly with receiver controllers 704*a*, 704*b* (generally 704), which also communicate over a network, such as the Internet, to a remote control facility 706. Receiver controllers 704 are preferably located within a few hundred feet of the receivers 702. Receiver controllers 704 are also made of composite material and also have embedded devices networked together. Receiver controllers 704 can be implemented in a redundant configuration. Communication over the Internet can also be encrypted using symmetric keys exchanged with a remote control facility using asymmetric encryption as is well understood in the art.

Both the receivers 702 and receiver controllers 704 can be hidden in walls or gates or loading cranes. Both 702, 704 are preferably ruggedized to operate in harsh environment. The receiver controller 704 is preferably connected to the Internet. Optionally, the receiver control 704 could have a connection for a local laptop.

The remote facility 706 processes information received from the receiver controllers 704 and fuses the information in order to remotely control the shipping containers 700 or other remote objects. In the case of shipping containers 700, the primary decision is whether (a) to permit loading of a container 700 onto a U.S. bound container ship and (b) at unloading, to permit the container to proceed into the interior of the U.S. The remote control facility could also communicate with receiver controllers located on board container ships.

There are approximately 10 million containers in the world. A remote facility with a Beowulf cluster environment and high speed internet access could communicate with all of these containers on a near real time basis.

Various embodiments of the securable structural member have been described herein. These embodiments are given by way of example and are not intended to limit the scope of the present invention. It should be appreciated, moreover, that the various features of the embodiments that have been described may be combined in various ways to produce numerous additional embodiments.

While this invention has been particularly shown and described with references to preferred embodiments thereof, it will be understood by those skilled in the art that various changes in form and details may be made therein without departing from the scope of the invention encompassed by the appended claims.

What is claimed is:

1. A tamper detection device, comprising:

a structural member configured for incorporation into a secured asset;

a plurality of dispersed, interconnected electronic components integrally attached to the structural member, more than one of the plurality of dispersed, interconnected electronic components including a memory element for storing a respective sub-division of at least one numeric value, the numeric value being stored among more than one of the plurality of dispersed, interconnected electronic components;

a remotely accessible interface in communication with the plurality of interconnected electronic components, the remotely accessible interface configured to allow remote management of the at least one stored numeric value; and at least one sensor operative to detect an attempt of unauthorized access to the secured asset.

2. The tamper detection device of claim 1, wherein the remotely accessible interface comprises a wireless interface.

3. The tamper detection device of claim 1, wherein at least one of the plurality of dispersed, interconnected electronic components comprises an encryption engine configured to allow encrypted remote management of the stored numeric value.

4. The tamper detection device of claim 3, wherein the encryption engine implements an asymmetric cryptographic process.

5. The tamper detection device of claim 1, further comprising a communications protocol whereby messages are exchanged between different electronic components of the plurality of dispersed, interconnected electronic components, an a tempt of unauthorized access being detected by an interruption to the exchange of messages.

6. The tamper detection device of claim 1, wherein the at least one sensor comprises a sensor grid embedded within the structural member.

7. The tamper detection device of claim 1 wherein the structural member comprises at least one interconnect configured to respectively communicate with at least one interconnect of a different structural member when joined thereto, the different structural member also including a plurality of dispersed, interconnected electronic components integrally attached thereto, so as to form a combined network of the plurality of dispersed, interconnected electronic components from each of the structural members.

8. The tamper detection device of claim 7, further comprising an alarm generating an alarm signal upon detection of separation of the joined structural members.

9. The tamper detection device of claim 7, wherein the stored numeric value is stored among more than one of the plurality of dispersed, interconnected electronic components of each of the joined structural members, a combined stored numeric value remotely accessible only when the structural members are joined, such that subsequent separation of the joined structural members, is detectable.

10. The tamper detection device of claim 1, wherein each electronic component of the dispersed, interconnected electronic components includes a respective low-power microprocessor operable in a sleep mode during low-power operations and transitioning to a wake mode upon detection of an external event.

11. A tamper detection device, comprising:

a structural member configured for incorporation into a secured asset;

a plurality of dispersed, interconnected electronic components integrally attached to the structural member more than one of the plurality of dispersed, interconnected electronic components including a memory element for storing a respective sub-division of at least one numeric value, the numeric value being stored among more than one of the plurality of dispersed, interconnected electronic components; and a remotely accessible interface in communication with the plurality of interconnected electronic components, the remotely accessible interface configured to allow remote management of the at least one stored numeric value, wherein each electronic component of the dispersed, interconnected electronic components includes a respective low-power microprocessor operable in a sleep mode during low-power operations and transitioning to a wake mode upon detection of an external event, and wherein incapacitation of at least one of the low-power microprocessors generates an external event to other low-power microprocessors of the dispersed, interconnected electronic components, causing them to transition to a wake mode, such a transition being indicative of an alarm condition.

12. A tamper detection device, comprising:

a structural member configured for incorporation into a secured asset;

a plurality of dispersed, interconnected electronic components integrally attached to the structural member, more than one of the plurality of dispersed, interconnected electronic components including a memory element for storing a respective sub-division of at least one numeric value, the numeric value being stored among more than one of the plurality of dispersed, interconnected electronic components;

a remotely accessible interface in communication with the plurality of interconnected electronic components, the remotely accessible interface configured to allow remote management of the at least one stored numeric value; and further comprising a tamper-detection grid substantially surrounding at least a portion of each electronic component of the plurality of dispersed, interconnected electronic components, the tamper-detection grid in communication with the surrounded electronic component and providing an alarm indication thereto in response to a breech of the tamper-detection grid.

13. The tamper detection device of claim 12, further comprising a fabric into which the tamper-detection grid is machine woven, the fabric insertable into the structural member as a unit during manufacture.

14. The tamper detection device of claim 12, further comprising a fabric into which the dispersed, interconnected electronic components are machine woven, the fabric insertable into the structural member as a unit during manufacture.

15. The tamper detection device of claim 14, wherein each of the electronic components includes a permanent battery also woven into the fabric.

16. The tamper detection device of claim 1, wherein each electronic component of the dispersed, interconnected electronic components in response to an alarm signal, permanently destroys at least a portion of the stored sub-division of the at least one numeric value stored therein, such that upon receipt of an alarm, certain values are permanently destroyed, so that an adversary could not return the system to the pre-alarm state.

17. The tamper detection device of claim 16, further comprising a high-energy device activated in response to a tamper alarm the high-energy device physically destroying the memory storing least a portion of the stored sub-division of the at least one numeric value.

18. The tamper detection device of claim 17, further comprising a fabric into which the high-energy device is machine woven, the fabric insertable into the structural member as a unit during manufacture.

19. The tamper detection device of claim 1, wherein the structural member comprises a dielectric material, the plurality of dispersed, interconnected electronic components being included within the dielectric material.

20. The tamper detection device of claim 1, each electronic component of the plurality of dispersed, interconnected electronic components comprises:

a microprocessor;

a memory in communication with the microprocessor, the memory configured to store the respective sub-division of the at least one numeric value; and a local power source in communication with at least the microprocessor.

21. The tamper detection device of claim 20, wherein the local power source is a battery.

22. The tamper detection device of claim 20, wherein the microprocessor is operable in a low-power mode during periods of inactivity, the microprocessor also capable of transitioning to a wake mode in response to an external event.

23. The tamper detection device of claim 20, wherein the structural member is a panel.

24. A shipping container comprising:

at least one structural member with a plurality of dispersed, interconnected processors embedded therein, each of the processors storing a respective sub-division of at least one numeric value, the numeric value being stored among more than one of the plurality of dispersed, interconnected processors;

a power source; and a high-energy device in communication with the power source and adapted to irretrievably destroy one or more of the sub-divisions of the at least one numeric value, the high-energy device being an area within a wall of the composite material, allowing a high-energy destruction processes to be undertaken against one or more of the processors containing sub-divisions of the at least one numeric value.

25. An tamper detection system, comprising:

a structural member configured for incorporation into a securable asset;

a plurality of dispersed, interconnected electronic components integrally attached to the structural member, more than one of the plurality of dispersed, interconnected electronic components including a memory element for storing a respective sub-division of at least one numeric value, the numeric value being stored among the more than one of the plurality of dispersed, interconnected electronic components;

a remotely accessible interface in communication with the plurality of interconnected electronic components, the remotely accessible interface configured to allow remote management of the at least one stored numeric value; and a remote monitor in communication with the remotely accessible interface, whereby numerical values are remotely installed into the structural member and verified without placing any trust in an on-site operator.

26. The tamper detection system of claim 25, further comprising a remote database in communication with the remote monitor for storing information related to the numerical values remotely installed into the structural member.

27. The tamper detection system of claim 25, further comprising an inspection machine in communication with the remote monitor, whereby a container is remotely inspected and, upon passing the inspection, provided with a certificate without having to trust any on-site operator.

28. A method for detecting attempts at tampering with a secured asset, comprising:

generating a numeric value;

subdividing the numeric value into a plurality of sub-divisions;

storing subdivisions of the numeric value in respective electrical components of a plurality of distributed, interconnected components contained within a structural member of the secured asset;

monitoring at least one tamper alarm; and destroying at least one of the stored subdivisions of the numeric value in response to the monitored tamper alarm indicating attempted tampering, the detected tampering being detectable by said destruction.

29. The method of claim 28, wherein the numeric value is an identification value associated with the secured asset.

30. The method of claim 28, wherein the numeric value is a certificate value indicative of an inspection of the secured asset.

31. The method of claim 28, wherein destroying the at least one of the stored subdivisions of the numeric value comprises deleting the stored value from a memory.

32. The method of claim 28, wherein destroying the at least one of the stored subdivisions of the numeric value comprises physically destroying at least a portion of a memory.

* * * * *